US010222735B2

(12) United States Patent
Yasukawa et al.

(10) Patent No.: US 10,222,735 B2
(45) Date of Patent: Mar. 5, 2019

(54) FIXING APPARATUS AND IMAGE FORMING APPARATUS

(71) Applicant: CANON KABUSHIKI KAISHA, Tokyo (JP)

(72) Inventors: Kouji Yasukawa, Tokyo (JP); Tsuyoshi Yamaguchi, Ichikawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/787,875

(22) Filed: Oct. 19, 2017

(65) Prior Publication Data

US 2018/0113404 A1 Apr. 26, 2018

(30) Foreign Application Priority Data

Oct. 25, 2016 (JP) ..... 2016-208503

(51) Int. Cl.
*G03G 15/20* (2006.01)
*G03G 15/00* (2006.01)

(52) U.S. Cl.
CPC ..... *G03G 15/80* (2013.01); *G03G 15/20* (2013.01); *G03G 15/205* (2013.01); *G03G 2215/2035* (2013.01)

(58) Field of Classification Search
CPC ..... G03G 15/20; G03G 15/205; G03G 15/80
See application file for complete search history.

(56) References Cited

U.S. PATENT DOCUMENTS 5,942,882 A * 8/1999 Ohta ..... G03G 15/2003 323/282
6,259,073 B1 7/2001 Inukai
7,332,692 B2 2/2008 Bourget et al.
7,351,937 B2 4/2008 Heerdt et al.
7,605,351 B2 10/2009 Bourget et al.
7,626,145 B2 12/2009 Bourget et al.

FOREIGN PATENT DOCUMENTS

JP H11-344882 A 12/1999
JP 2000-020141 A 1/2000
JP 2002-351253 A 12/2002
JP 2008-541352 A 11/2008

* cited by examiner

*Primary Examiner* — David M. Gray
*Assistant Examiner* — Andrew V Do
(74) *Attorney, Agent, or Firm* — Venable LLP

(57) ABSTRACT

A fixing apparatus includes a transformer, a heater, a temperature acquiring portion, and control portion. A first switching unit allows or cuts off power supply from a primary-side circuit to the heater by supplying power, and a second switching unit allows or cuts off power supply from the primary-side circuit to the temperature acquiring portion by supplying power. The power supply to the heater can be allowed or cut off according to the temperature of the heater acquired by the temperature acquiring portion. In addition, the control portion cuts off power supply from the primary-side circuit to the heater and power supply from the primary-side circuit to the temperature acquiring portion by controlling operations of the first switching unit and the second switching unit with the one signal.

14 Claims, 6 Drawing Sheets

FIXING APPARATUS AND IMAGE FORMING APPARATUS

BACKGROUND OF THE INVENTION

This application claims the benefits of Japanese Patent Application No. 2016-208503, filed on Oct. 25, 2016 which is hereby incorporated by reference herein in its entirety.

Field of the Invention

The present invention relates to a fixing apparatus that fixes a developer image, formed on a recording material, to the recording material, and an image forming apparatus that forms an image on a recording medium by using a developer.

Description of the Related Art

In an electrophotographic image forming apparatus, such as a copying machine or a laser beam printer, first, a photosensitive drum is charged by a charging roller and the charged photosensitive drum is exposed by an exposure device, whereby an electrostatic latent image is formed on the photosensitive drum. The electrostatic latent image formed on the photosensitive drum is developed as a toner image by a developing roller. Then, the toner image formed on the photosensitive drum is transferred to a recording material, such as paper, by a transfer roller. The toner image transferred to the recording material is fixed to the recording material by heating and pressurizing with a fixing apparatus. In this way, an image is formed on the recording material.

Here, the fixing apparatus sometimes includes a heater for heating the recording material and a thermistor for measuring the temperature of the heater. A heat generation pattern (metal resistor) is formed on the heater, and, when an electrical current flows in the heat generation pattern, and the heat generation pattern generates heat to heat the heater. Further, since the resistance value of the thermistor varies depending on the temperature, the temperature of the heater is measured by measuring the resistance value of the thermistor.

In addition, conventionally, since the power consumed by the heat generation pattern is large, the heat generation pattern is heated by power supplied from a primary-side circuit. Meanwhile, the thermistor is electrically connected to a secondary-side circuit. Since the heat generation pattern is connected to the primary-side circuit and the thermistor is connected to the secondary-side circuit, it is necessary to provide a sufficient insulation distance between the heat generation pattern and the thermistor. This is because a short circuit occurs when the heat generation pattern connected to the primary-side circuit and the thermistor connected to the secondary-side circuit are electrically connected. When it is thus necessary to provide a sufficient insulation distance between the heat generation pattern and the thermistor, the size of the fixing apparatus is increased, which results in the increased size of the image forming apparatus.

Accordingly, in the technique disclosed in Japanese Patent Application Publication No. H11-344882, both the heater and the thermistor are connected to the primary-side circuit, thereby making it possible to eliminate the occurrence of a short circuit and to arrange the heater and the thermistor close to each other. As a result, the fixing apparatus is reduced in size, and the entire image forming apparatus can be reduced in size. Specifically, in the technique disclosed in Japanese Patent Application Publication No. H11-344882, the fixing apparatus includes the heater, the thermistor, a converting unit for converting the temperature of the thermistor into a predetermined signal, and a photocoupler for converting the signal converted by the converting unit into an electric pulse signal. The fixing apparatus is also provided with a switching unit for switching supply/cutoff of electrical power from the primary-side circuit to the heater according to the electrical pulse signal converted by the photocoupler.

The heater, the thermistor, and the converting unit are driven by the primary-side circuit, and the switching unit is driven by the secondary-side circuit. Then, a predetermined signal (the signal relating to the temperature of the thermistor) converted by the converting unit is converted by the photocoupler into an electrical pulse signal, and electrical power is supplied/cutoff to the heater according to the electrical pulse signal. In the technique disclosed in Japanese Patent Application Publication No. H11-344882, the photocoupler can send a signal from the converting unit to the switching unit in a state in which the converting unit (by the primary-side circuit) and the switching unit are insulated. Therefore, it is possible to send a signal from the converting unit to the switching unit without causing a short circuit. In addition, both the thermistor and the heater receive the supply of electrical power from the primary-side circuit, and, even when the thermistor and the heater are arranged close to each other, the primary-side circuit and the secondary-side circuit cannot be electrically connected (there is no danger of short circuit).

Japanese Patent Application Publication No. H11-344882 does not, however, disclose the feature of cutting off the power supply from a commercial power supply to the converting unit when the temperature of the heater exceeds a threshold value or when the image forming apparatus is switched to a power saving mode. Therefore, according to the technique disclosed in Japanese Patent Application Publication No. H11-344882, when the temperature of the heater exceeds a threshold value, or the like, the power supply from the commercial power supply to the converting unit is not cut off and power is consumed in the converting unit.

A virtual technique can be considered in which the feature of cutting off the power supply from the commercial power supply to the heater and the converting unit when the temperature of the heater exceeds the threshold value, or the like, is used in the technique disclosed in Japanese Patent Application Publication No. H11-344882. In order to use the virtual technique, it is apparently necessary to send separate signals from a central processing unit (CPU) to the conversion unit and a member that cuts off the power supply to the heater. Therefore, it is necessary to newly add a CPU control port (input/output port of a CPU), a transistor, and the like. In this case, the manufacturing cost of the fixing apparatus increases.

SUMMARY OF THE INVENTION

The objects of the present invention are, therefore, to reduce the manufacturing cost of the fixing apparatus and to reduce power consumption in the fixing apparatus.

In order to achieve the objects described above, in one aspect, the present invention provides a fixing apparatus comprising a transformer that transforms power received from a primary-side circuit and sends the transformed power to a secondary-side circuit, a heater for generating heat when the power is supplied from the primary-side circuit, a temperature acquiring portion that is actuated by the power supplied from the primary-side circuit and acquires a temperature of the heater on the basis of heat transmitted from the heater, a control portion that is actuated by the power supplied from the secondary-side circuit, a first switching unit for allowing or cutting off power supply from the primary-side circuit to the heater by supplying power, and a second switching unit for allowing or cutting off power supply from the primary-side circuit to the temperature acquiring portion by supplying power, wherein the power supply to the heater can be allowed or cut off according to the temperature of the heater acquired by the temperature acquiring portion, and wherein the control portion cuts off power supply from the primary-side circuit to the heater and power supply from the primary-side circuit to the temperature acquiring portion by controlling operations of the first switching unit and the second switching unit with one signal.

In order to achieve the objects described above, in another aspect, the present invention provides an image forming apparatus comprising the above described fixing apparatus, wherein a developer image formed on a recording medium is heated by the fixing apparatus to fix the developer image on the recording medium.

Further features of the present invention will become apparent from the following description of exemplary embodiments with reference to the attached drawings.

DESCRIPTION OF THE EMBODIMENTS

Embodiment 1

Hereafter, a description will be given, with reference to the drawings, of embodiments of the present invention. The sizes, materials, shapes, their relative arrangements, or the like, of constituents described in the embodiments may, however, be appropriately changed according to the configurations, various conditions, or the like, of apparatuses to which the invention is applied. Therefore, the sizes, materials, shapes, their relative arrangements, or the like, of the constituents described in the embodiments do not intend to limit the scope of the invention to the following embodiments.

Description of Image Forming Apparatus 100

Figure 1:
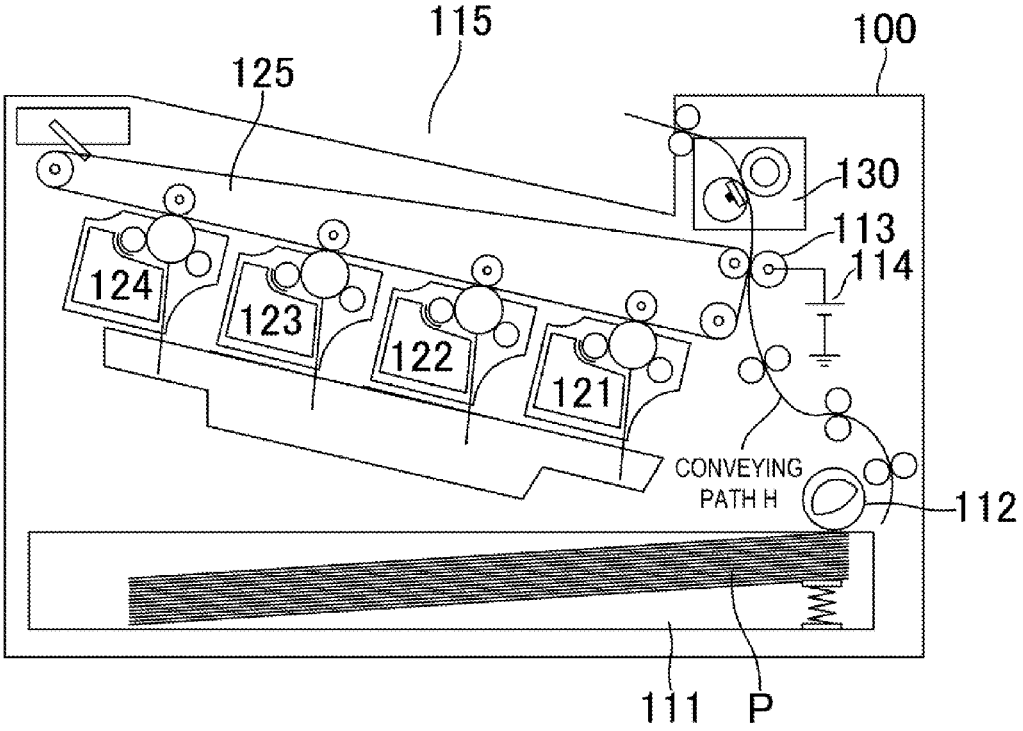
FIG. 1 is a diagram showing the configuration of an image forming apparatus according to Embodiment 1.

FIG. 1 is a diagram showing the configuration of an image forming apparatus 100 according to the present embodiment. Monochrome toner images (corresponding to developer images) of yellow (Y), magenta (M), cyan (C), and black (K) colors are formed on photosensitive drums 121 to 124, respectively. By superimposing the toner images of these four colors on an intermediate transfer member 125, a multicolor toner image is formed on the intermediate transfer member 125.

Meanwhile, image recording paper P (corresponding to the recording medium), fed from a paper feeding unit 111 by a paper feeding roller 112, is conveyed along a conveying path H, and is nipped and conveyed together with the multicolor toner image formed on the intermediate transfer member 125 between the intermediate transfer member 125 and the transfer roller 113. Since a positive bias is applied to the transfer roller 113 from a transfer bias generator 114, the negatively charged multicolor toner image is transferred to the image recording paper P. Thereafter, the multicolor toner image on the image recording paper P is fixed to the image recording paper P by a thermal fixing apparatus 130. The image recording paper P, on which the multicolor toner image has been fixed, is finally discharged to a discharge tray 115.

Outline of Thermal Fixing Apparatus 130

Figure 2:
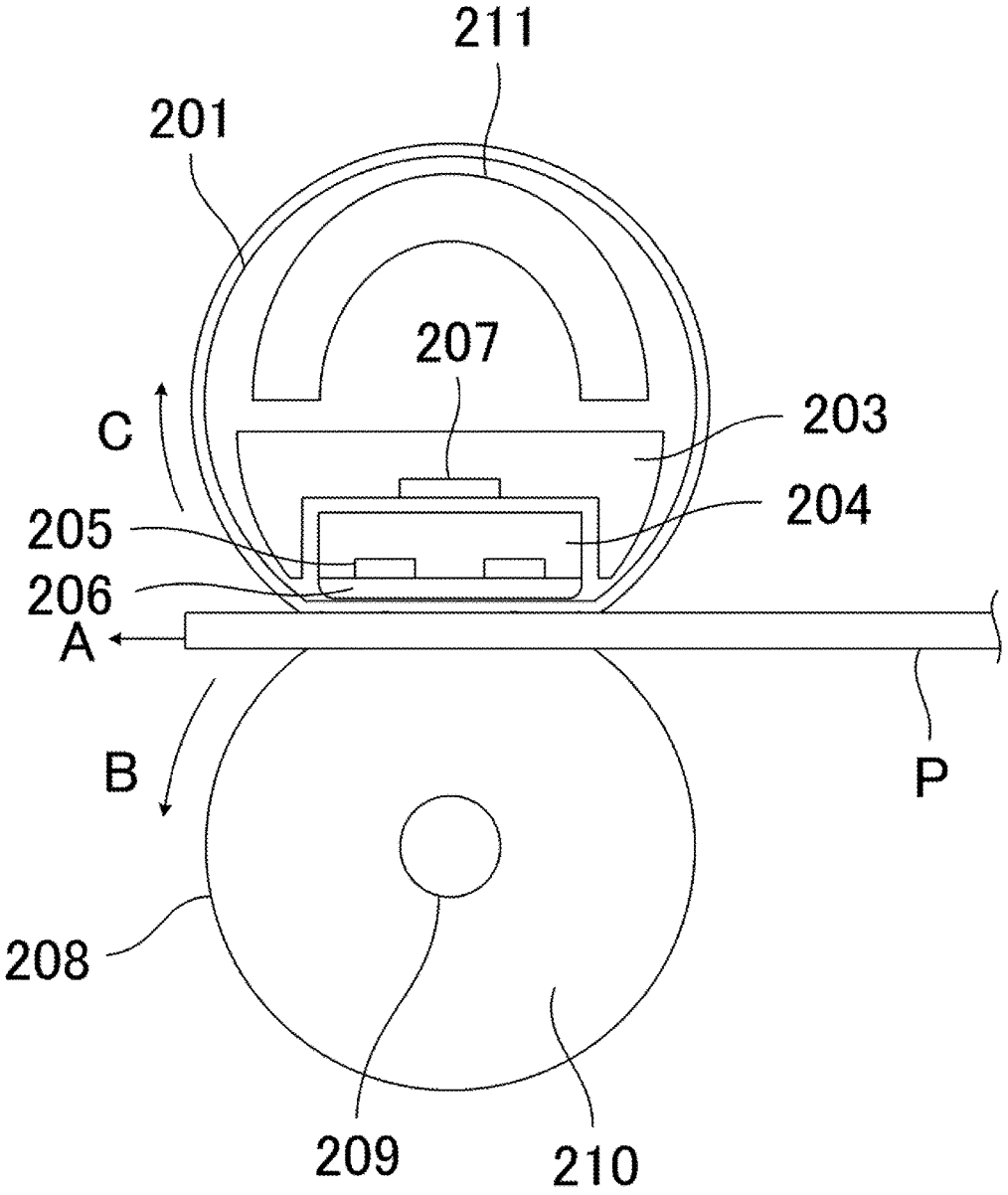
FIG. 2 is a diagram showing the configuration of a thermal fixing apparatus according to Embodiment 1.

Next, the thermal fixing apparatus 130 will be described with reference to FIG. 2. FIG. 2 is a diagram showing the configuration of the thermal fixing apparatus 130 according to the present example. A heater 204 is made of ceramic. A heating element pattern 205 is formed on the heater 204, and the heater 204 is covered with an insulating layer 206 of glass, or the like. Further, the insulating layer 206 is preferably as thin as possible so that heat can be efficiently conducted from the heater 204 to the image recording paper P.

Generally, the heating element pattern 205 is connected to a commercial power supply through a switching element, such as a TRIAC, or a mechanical switching element, such as a relay. By controlling ON/OFF of the switching element, electrical power is supplied from the commercial power supply to the heating element pattern 205. The ON/OFF control of the switching element is performed based on the resistance value of the thermistor 207 (corresponding to the sensor) disposed in the vicinity of the heater 204 (for example, pressed against the back surface of the heater 204 with a predetermined pressure). Here, the resistance value of the thermistor 207 varies depending on the temperature of the thermistor 207. Therefore, in the present embodiment, the temperature of the thermistor 207 is measured from the resistance value of the thermistor 207.

Further, a heater holder 203 serves for fixing and supporting the heater 204, and is formed of a material having heat resistance and heat insulating properties. A metal stay 211 is a member for imparting rigidity to the thermal fixing apparatus 130. A fixing film 201 is a cylindrical heat-resistant film material, and is disposed so as to cover the heater 204, the heater holder 203, and the like. A monolayer film, a composite film composed of a polyimide (PI) and perfluoroalkoxy alkane (PFA) coating or stainless steel (SUS) with a rubber coating, or the like, is used as the fixing film 201, and the inner circumferential surface of the fixing film 201 has high electrical conductivity.

A pressure roller 208 is an elastic roller formed by providing a heat-resistant elastic layer 210, such as silicone rubber, in a roller shape on the outer periphery of a metal pipe 209. Then, the pressure roller 208 is pressed against the heater 204, with the fixing film 201 being interposed therebetween, and is driven to rotate at a predetermined peripheral speed in the direction of an arrow B by a fixing drive motor (not shown in the figure). The pressure roller 208 rotates the fixing film 201 by the rotational driving of the pressure roller 208 and the frictional force between the outer peripheral surface of the pressure roller 208 and the outer peripheral surface of the fixing film 201. At this time, the fixing film 201 rotates in the direction of an arrow C while sliding on the insulating layer 206. Here, the heater holder 203 also plays a role of guiding the inner peripheral surface of the fixing film 201, so that the fixing film 201 can be easily rotated.

The image recording paper P onto which the multicolor toner image has been transferred is conveyed to a nip portion between the fixing film 201 and the pressure roller 208 in a state after the rotation of the fixing film 201 has been stabilized by the rotation of the pressure roller 208 and the temperature of the heater 204 has risen to a predetermined temperature. Here, as shown in FIG. 2, the image recording paper P is conveyed in the direction of an arrow A. Then, the conveyed image recording paper P is pressed together with the fixing film 201 toward the heater 204 by the pressure roller 208. As a result, the heat of the heater 204 is transmitted to the image recording paper P through the fixing film 201, and the multicolor toner image is fixed to the image recording paper P.

Circuit Constituting Thermal Fixing Apparatus 130

Figure 3:
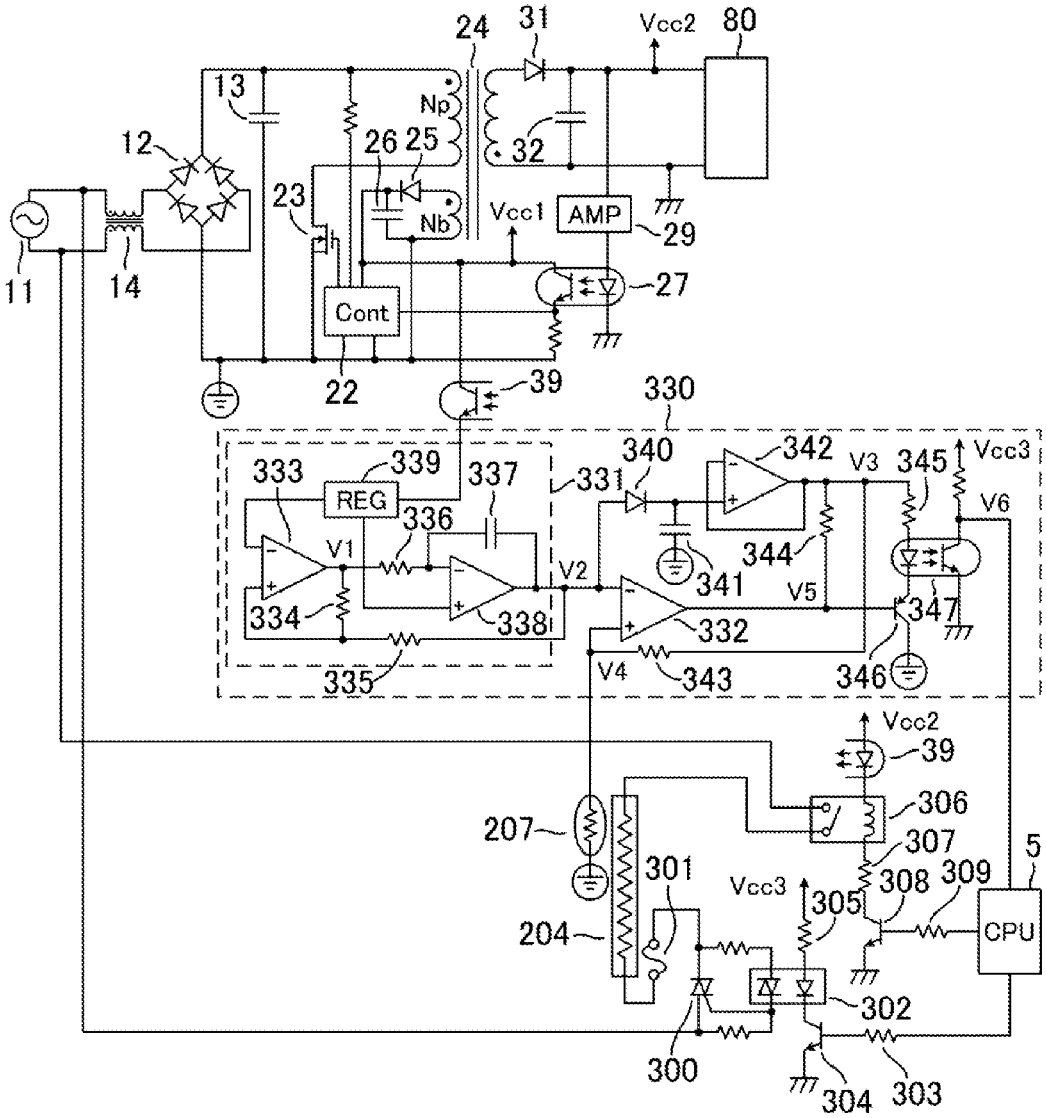
FIG. 3 is a circuit diagram showing the thermal fixing apparatus according to Embodiment 1.

FIG. 3 is a circuit diagram showing the thermal fixing apparatus 130 according to this example. As shown in FIG. 3, a commercial power supply 11, a common mode choke coil 14, a diode bridge 12, a smoothing capacitor 13, a transformer 24, a field-effect transistor (FET) 23, a control circuit 22, a photocoupler 27, and the like, constitute a power supply circuit. In the secondary-side circuit of the power supply circuit of the thermal fixing apparatus 130, the secondary-side power supply Vcc2 is outputted by a rectifier diode 31 and a capacitor 32. The secondary-side power supply Vcc2 supplies power to a load 80, such as a motor provided in the image forming apparatus 100. The electrical current flowing from the secondary-side power supply Vcc2 is changed by an amplifier (AMP) 29, which is an error amplifier, and then flows to the photocoupler 27. The AMP 29 constitutes a feedback loop such that it changes the value of the current flowing through the AMP 29. The transformer 24 transforms power received from the primary-side circuit and sends the transformed power to the secondary-side circuit.

Meanwhile, the commercial power supply 11 supplies electrical power to a heater 204 via a TRIAC 300. Further, the TRIAC 300 is connected through a photo-TRIAC coupler 302 to a transistor 304, connected through a resistor 303 to a CPU 5 as a control unit connected to the secondary-side circuit. In accordance with the two types of signals Hi and Lo, the CPU 5 causes an electrical current to flow through a limiting resistor 305 to the diode side of the photo-TRIAC coupler 302. As a result, the CPU 5 controls the operation of the photo-TRIAC coupler 302 and switches supply/cutoff of electrical power from the commercial power supply 11 to the heater 204. In this example, the CPU 5 controls the operation of the photo-TRIAC coupler 302 in accordance with the temperature of the heater 204 acquired by a thermistor circuit block 330 as the temperature acquiring unit, so that power supply from the commercial power supply 11 to the heater 204 is allowed or cut off.

Further, in the thermal fixing apparatus 130, the thermistor 207 and a protective element 301 for cutting off the energization to the heater 204 when the heater 204 abnormally generates heat are arranged in the vicinity of the heater 204. In addition, the thermal fixing apparatus 130 is provided with a relay 306 (corresponding to a first switching unit) for cutting off the energization to the heater 204 by a control signal from the CPU 5 on the basis of information on the temperature of the thermistor 207. The relay 306 is connected to the CPU 5 through a resistor 309 and a transistor 308 (corresponding to a third switching unit). The CPU 5 controls the supply/cutoff of electrical power to the relay 306 by allowing an electrical current to flow through the limiting resistor 307 to the coil inside the relay 306 in accordance with the two types of signals Hi and Lo. Here, in the present embodiment, the photocoupler 39 (corresponding to a second switching unit), which will be described in detail below, is connected in series with the relay 306. In this example, the relay 306, the photocoupler 39, and the transistor 308 are operated by supply of electrical power from the secondary-side circuit.

Thermistor Circuit Block 330

Next, the thermistor circuit block 330 and circuits disposed on the periphery thereof will be described. In this example, the heater 204, the thermistor 207, and the protective element 301 are all disposed in the primary-side circuit of the transformer 24. As a result, the components connected to the secondary-side circuit are not disposed in the thermal fixing apparatus 130. Therefore, even though the heater 204, the thermistor 207, and the protective element 301 are arranged at positions close to each other, the primary-side circuit and the secondary-side circuit are prevented from being connected to each other (a short circuit does not occur) in the thermal fixing apparatus 130. Furthermore, there is no need to provide a safe distance between the heater 204, the thermistor 207, and the protective element 301, and, since the heater 204, the thermistor 207, and the protective element 301 can be disposed close to each other, the thermal fixing apparatus 130 can be reduced in size.

A voltage is supplied to the thermistor circuit block 330 from an auxiliary winding Nb of the transformer 24. In the auxiliary winding Nb, similarly to the secondary-side power supply Vcc2, a primary-side power supply Vcc1 is generated by a rectification diode 25 and a capacitor 26 in accordance with the switching of the FET 23. The CPU 5 controls the supply/cutoff of electric power from the primary-side power supply Vcc1 to the thermistor circuit block 330 by controlling the operation of the photocoupler 39 through the resistor 309 and the transistor 308. In the thermistor circuit block 330, the detection signal of the thermistor 207 is converted into a PWM signal, which will be described below, and fed back to the CPU 5 through the photocoupler 347 as a transmission portion.

Pulse Width Modulation (PWM) Conversion of Detection Signal of Thermistor 207

The thermistor circuit block 330 is mainly configured of a triangular wave generating portion 331 and a comparator 332 for comparing the triangular wave and the voltage of the thermistor 207. In the triangular wave generating portion 331, an operational amplifier 333, a resistor 334, and a resistor 335 form a Schmitt circuit, thereby generating a rectangular wave V1. In addition, an operational amplifier 338, a resistor 336, and a capacitor 337 form an integrator, thereby generating a triangular wave V2.

Figure 4:
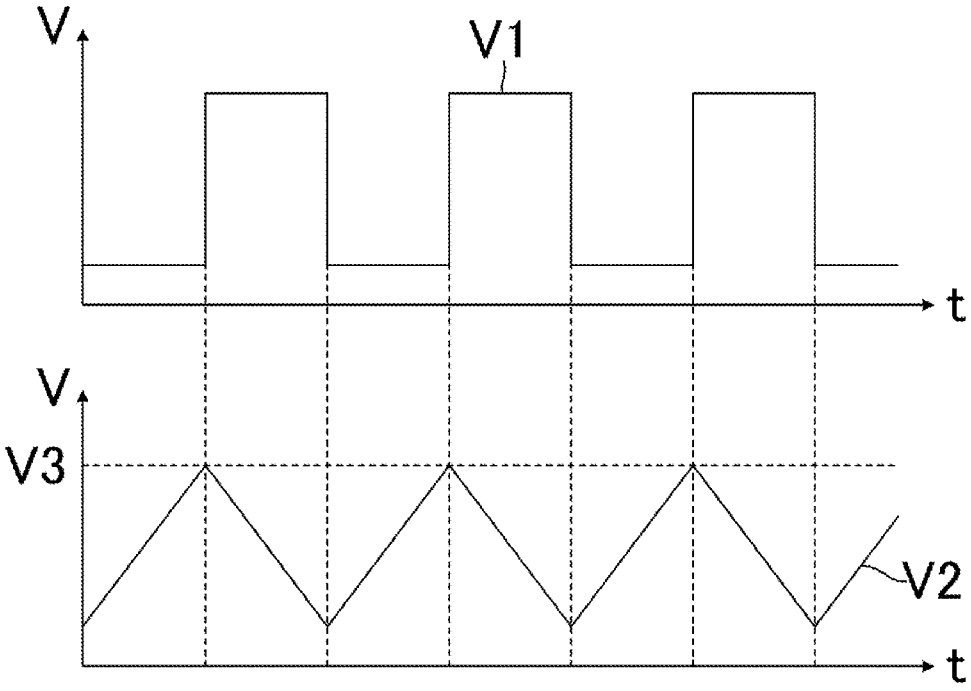
FIG. 4 is a diagram showing waveform examples of a rectangular wave in a Schmitt circuit and a triangular wave in an integrator.

Here, FIG. 4 is a diagram showing waveform examples of the rectangular wave V1 generated by the Schmitt circuit and the triangular wave V2 generated by the integrator. The peak voltage of the triangular wave V2 is set as a voltage V3. A voltage which is made a high-precision voltage in a regulation circuit REG 2, is used as the reference voltage of the operational amplifier 333 and the operational amplifier 338. The triangular wave V2 is inputted to the comparator 332, and the triangular wave V2 is inputted to an operational amplifier 342 functioning as a voltage follower by the voltage V3 rectified by a diode 340 and a capacitor 341. Further, the voltage of the thermistor 207 is divided by a resistor 343 into a voltage V4. Then, the voltage V3 and the voltage V4 are compared by the comparator 332. Here, the portion where the voltage is the voltage V3 is connected to the comparator 332 through the resistor 344 and is connected to a transistor 346 and a photocoupler 347 through a resistor 345. Here, as a characteristic of the thermistor 207, the resistance of the thermistor 207 decreases as the temperature of the thermistor 207 rises, and rises as the temperature of the thermistor 207 decreases. Therefore, when the temperature of the thermistor 207 rises, the voltage V4 decreases, and when the temperature of the thermistor 207 decreases, the voltage V4 rises.

Figure 5A:
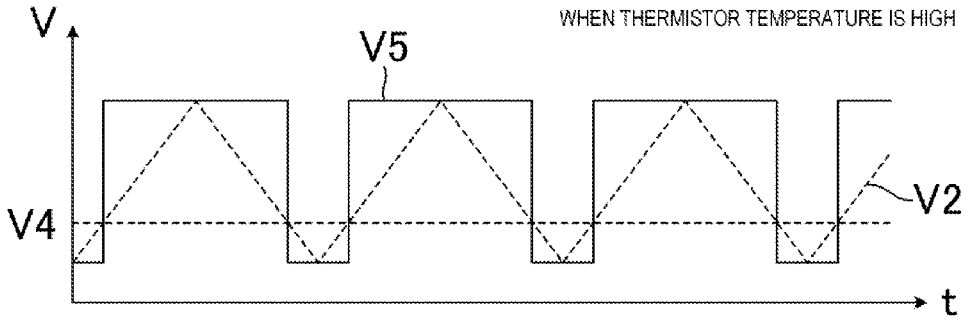
FIGS. 5A and 5B are diagrams showing the output voltage of a comparator according to Embodiment 1.
Figure 5B:
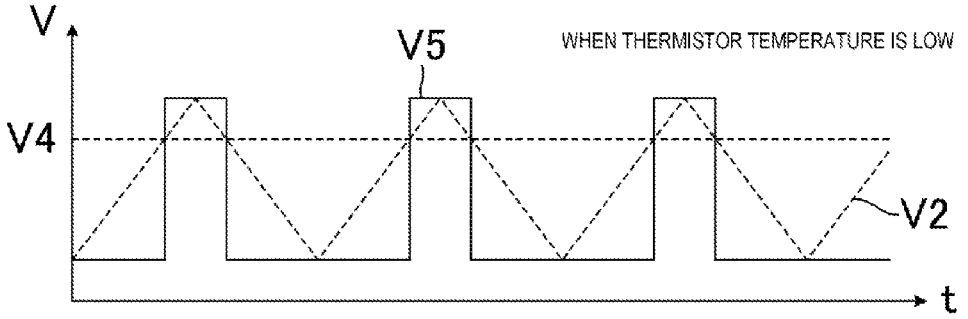

FIGS. 5A and 5B show an output voltage V5 of the comparator 332 when the temperature of the thermistor 207 is high and when the temperature of the thermistor 207 is low respectively. When the voltage V4 is less than the triangular wave V2 (when the temperature of the thermistor 207 is high), the on-DUTY of the voltage V5 increases. Meanwhile, when the voltage V4 is greater than the triangular wave V2 (when the temperature of the thermistor 207 is low), the on-DUTY of the voltage V5 decreases.

Here, in the present embodiment, the signal is transmitted from the comparator 332 connected to the primary-side circuit to the CPU 5 connected to the secondary-side circuit by using the photocoupler 347. More specifically, the voltage V5 outputted from the comparator 332 is converted into a pulse signal having a pulse width by the photocoupler 347, and is thus transmitted to the CPU 5 as a voltage V6. The photocoupler 347 can transmit the output signal (output voltage V5) of the comparator 332 to the CPU 5 in a state in which the CPU 5 connected to the secondary-side circuit and the comparator 332 connected to the primary-side circuit are insulated from each other. Further, in this embodiment, as a result of using the transistor 346, Hi and Lo logic of the voltage V5 and the voltage V6 are the same. The portion where the voltage is Vcc3 is a secondary-side circuit, and the voltage Vcc3 is generated from the secondary-side power supply Vcc2 by a DC/DC converter (not shown in the figure), or the like. In this manner, the temperature of the thermistor 207 is outputted as the voltage V5 by the comparator 332, and the outputted voltage V5 is fed back as the voltage V6 to the CPU 5.

Operation Control of Relay 306 and Photocoupler 39

In the present embodiment, as described above, the photocoupler 39 and the relay 306 are connected in series, and the operation of the transistor 308 is controlled with one signal from the CPU 5. Specifically, in this example, the transistor 308 is connected to the CPU 5 through the resistor 309. Further, the photocoupler 39, the relay 306, and the limiting resistor 307 are connected in series to the transistor 308. Thus, ON/OFF of the relay 306 and the photocoupler 39 are simultaneously controlled. In other words, in the present example, the CPU 5 can cut off the power supply from the commercial power supply 11 to the heater 204 and the power supply from the commercial power supply 11 to the thermistor circuit block 330 by controlling the operations of the photocoupler 39 and the relay 306 with one signal.

Since the photocoupler 39 and the relay 306 are connected to the CPU 5 in this manner, power is supplied from the primary-side power supply Vcc1 to the thermistor circuit block 330 only when the relay 306 is turned on. As a result, power saving is achieved in the thermal fixing apparatus 130. Further, when no power is supplied to the thermistor circuit block 330 and the temperature of the thermistor 207 is not detected, the relay 306 is switched off and the energization to the heater 204 is also cut off, so that the safety of the thermal fixing apparatus 130 is enhanced. In this example, the operation of the transistor 308 is controlled with one signal from the CPU 5, so that ON/OFF of the relay 306 and the photocoupler 39 are simultaneously controlled, thereby making it possible to reduce the number of ports of the CPU 5.

As described above, in this example, the CPU 5 cuts off the power supply from the primary-side circuit to the heater 204 and the power supply from the primary-side circuit to the thermistor circuit block 330 by controlling the operations of the photocoupler 39 and the relay 306 with one signal. Thus, it is possible to cut off the power supply from the commercial power supply 11 to the thermistor circuit block 330 and the heater 204 without adding components such as a CPU control port or a transistor.

Embodiment 2

Figure 6:
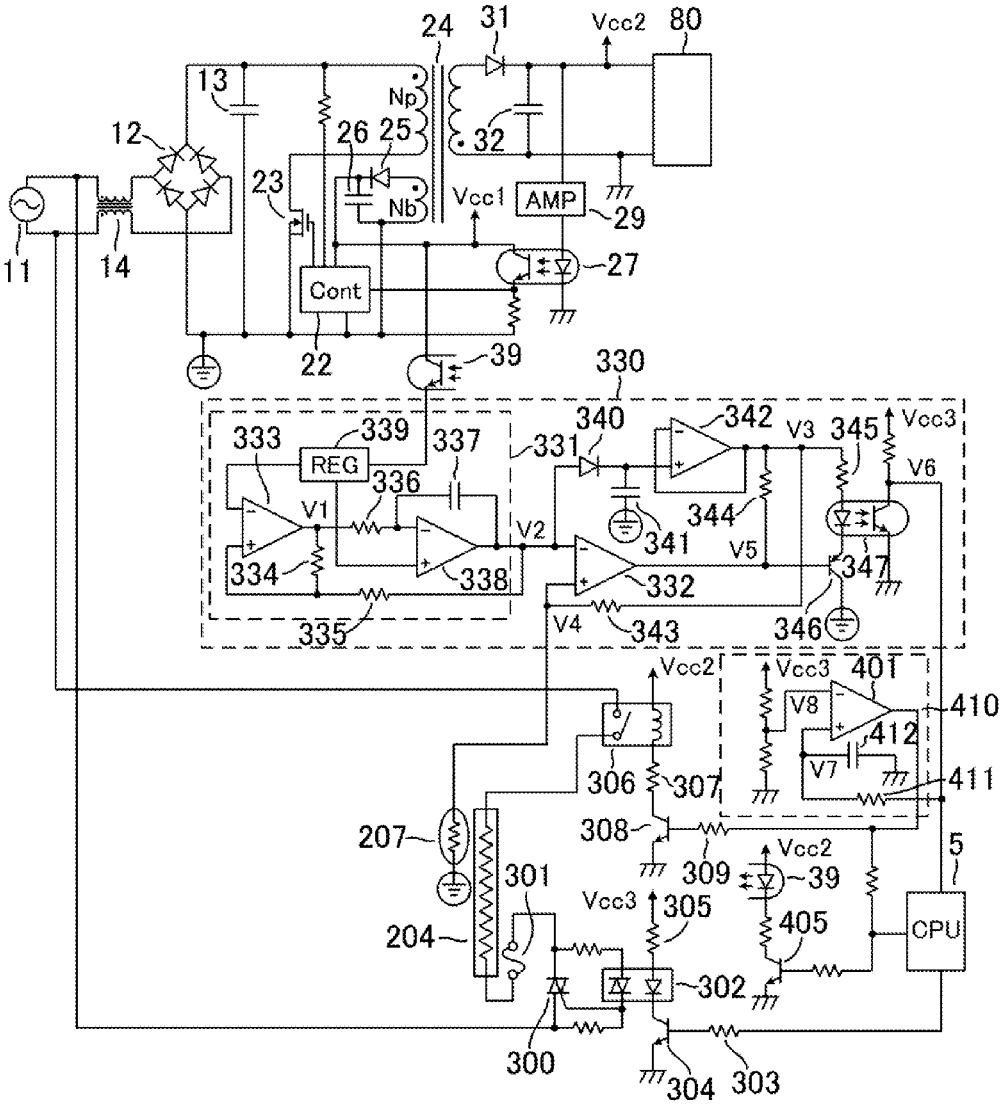
FIG. 6 is a circuit diagram showing a thermal fixing apparatus according to Embodiment 2.

FIG. 6 is a circuit diagram showing a thermal fixing apparatus 130 according to Embodiment 2. Here, in this example, components having the same functions as those of the Embodiment 1 are denoted by the same reference numerals, and the description thereof is omitted. Unlike Embodiment 1, in this example, in addition to controlling the operations of the relay 306 and the photocoupler 39 with one signal from the CPU 5, the operation of an abnormally high temperature detection block 410 serving as a switching unit control portion is also controlled by one signal from the CPU 5. Specifically, in the present embodiment, the transistor 308 that ON/OFF switches the power supply to the relay 306 and the transistor 405 that ON/OFF switches the power supply to the photocoupler 39 are controlled with one signal from the CPU 5. Furthermore, in the present embodiment, the abnormally high temperature detection block 410 operates regardless of the signal from the CPU 5. In other words, in the present embodiment, the CPU 5 cuts off the power supply from the primary-side circuit to the heater 204 and the power supply from the primary-side circuit to the thermistor circuit block 330 by controlling the operations of the relay 306 and the photocoupler 39 with one signal.

The abnormally high temperature detection block 410 monitors the voltage V7 generated by rectifying the voltage V6 outputted from the thermistor circuit block 330 by a resistor 411 and a capacitor 412. Further, when the voltage V7 falls below a voltage V8, which is set as an abnormally high temperature, a comparator 401 is switched off. Thus, power supply to the relay 306 is cut off by switching off the transistor 308.

Therefore, even when an abnormality occurs in the firmware of the CPU 5, and the temperature of the heater 204 becomes abnormally high, the power supply to the relay 306 can be cut off and the power supply to the heater 204 can be cut off regardless of the CPU 5. In other words, in the present example, even when there is an abnormality in the firmware of the CPU 5, the abnormally high temperature detection block 410 can cut off the power supply to the heater 204 before the power supply to the heater 204 is cut off by the protective element 301.

Here, in the present embodiment, unlike Embodiment 1, the relay 306 and the abnormally high temperature detection block 410, and the photocoupler 39 are connected in parallel to the CPU 5 so that the power supply of the thermistor circuit block 330 is not cut off at the same time as the transistor 308 is switched off. Therefore, in this example, a transistor 405 is added to ON/OFF switch the power supply to the photocoupler 39. In other words, in this example, unlike Embodiment 1, two transistors are used for one signal of the CPU 5.

As described above, in the present embodiment, it is possible to cut off the power supply from the commercial power supply 11 to the thermistor circuit block 330 and the heater 204 without adding a CPU control port.

Further, in the present embodiment, as described above, even when there is an abnormality in the firmware of the CPU 5, the abnormally high temperature detection block 410 can cut off the power supply to the heater 204 before the power supply to the heater 204 is cut off by the protective element 301.

In the embodiments, the switching unit for allowing or cutting off the power supply to the thermistor circuit block 330 and the heater 204 is not necessarily required to be turned on by the power supply to the switching unit. For example, the switching unit for allowing or cutting off the power supply to the thermistor circuit block 330 and the heater 204 may be switched off by the power supply to the switching unit.

Further, in the embodiments, the switching unit for allowing or cutting off the power supply to the thermistor circuit block 330 and the heater 204 is not necessarily a relay or a photocoupler. The configuration of the switching unit is not particularly limited, as long as the power supply to the thermistor circuit block 330 and the heater 204 is allowed or cut off by a signal from the CPU 5.

The present invention can reduce the manufacturing cost of the fixing apparatus and reduce power consumption in the fixing apparatus.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. A fixing apparatus comprising:

a transformer that transforms power received from a primary-side circuit and sends the transformed power to a secondary-side circuit;

a heater for generating heat when the power is supplied from the primary-side circuit;

a temperature acquiring portion that is actuated by the power supplied from the primary-side circuit and acquires a temperature of the heater on the basis of heat transmitted from the heater;

a control portion that is actuated by the power supplied from the secondary-side circuit;

a first switching unit for allowing or cutting off power supply from the primary-side circuit to the heater by supplying power; and a second switching unit for allowing or cutting off power supply from the primary-side circuit to the temperature acquiring portion by supplying power, wherein the power supply to the heater can be allowed or cut off according to the temperature of the heater acquired by the temperature acquiring portion, and wherein the control portion cuts off power supply from the primary-side circuit to the heater and power supply from the primary-side circuit to the temperature acquiring portion by controlling operations of the first switching unit and the second switching unit with one signal.

2. The fixing apparatus according to claim 1, further comprising a third switching unit for allowing or cutting off power supply to the first switching unit and the second switching unit, wherein the control portion cuts off power supply from the primary-side circuit to the heater and power supply from the primary-side circuit to the temperature acquiring portion by controlling an operation of the third switching unit with the one signal.

3. The fixing apparatus according to claim 2, wherein the first switching unit, the second switching unit, and the third switching unit are connected in series.

4. The fixing apparatus according to claim 2, wherein the third switching unit is a transistor.

5. The fixing apparatus according to claim 2, wherein the first switching unit, the second switching unit, and the third switching unit are actuated by the power supplied from the secondary-side circuit.

6. The fixing apparatus according to claim 1, further comprising a switching unit control portion that controls an operation of the first switching unit according to the temperature of the heater acquired by the temperature acquiring portion, wherein the control portion cuts off power supply from the primary-side circuit to the heater and power supply from the primary-side circuit to the temperature acquiring portion by controlling operations of the first switching unit and the second switching unit with one signal.

7. The fixing apparatus according to claim 6, wherein the switching unit control portion, the first switching unit, and the second switching unit are connected in parallel.

8. The fixing apparatus according to claim 1, further comprising a transmission portion that transmits the temperature of the heater acquired by the temperature acquiring portion to the control portion in a state in which the temperature acquiring portion and the control portion are insulated from each other.

9. The fixing apparatus according to claim 8, wherein the temperature acquiring portion has a sensor that converts the heat transmitted from the heater into a signal, and the transmission portion converts the signal of the sensor into a pulse signal having a pulse width.

10. The fixing apparatus according to claim 1, wherein the second switching unit is a photocoupler.

11. The fixing apparatus according to claim 1, wherein the temperature acquiring portion includes a sensor that converts heat transmitted from the heater into a signal, and acquires the temperature of the heater on the basis of the signal of the sensor.

12. The fixing apparatus according to claim 11, wherein the sensor is a thermistor.

13. The fixing apparatus according to claim 1, wherein the heater heats a developer image formed on a recording medium to fix the developer image on the recording medium.

14. An image forming apparatus comprising:

a fixing apparatus including:

(a) a transformer that transforms power received from a primary-side circuit and sends the transformed power to a secondary-side circuit (b) a heater for generating heat when the power is supplied from the primary-side circuit:

(c) a temperature acquiring portion that is actuated by the power supplied from the primary-side circuit and acquires a temperature of the heater on the basis of heat transmitted from the heater;

(d) a control portion that is actuated by the power supplied from the secondary-side circuit (e) a first switching unit for allowing or cutting off power supply from the primary-side circuit to the heater by supplying power; and (d) a second switching unit for allowing or cutting off power supply from the primary-side circuit to the temperature acquiring portion by supplying power, wherein the power supply to the heater can be allowed or cut off according to the temperature of the heater acquired by the temperature acquiring portion, wherein the control portion cuts off power supply from the primary-side circuit to the heater and power supply from the primary-side circuit to the temperature acquiring portion by controlling operations of the first switching unit and the second switching unit with one signal, and wherein a developer image formed on a recording medium is heated by the fixing apparatus to fix the developer image on the recording medium.

* * * * *